US006407708B1

(12) United States Patent
Jasper, Jr.

(10) Patent No.: US 6,407,708 B1
(45) Date of Patent: Jun. 18, 2002

(54) MICROWAVE GENERATOR/RADIATOR USING PHOTOCONDUCTIVE SWITCHING AND DIELECTRIC LENS

(75) Inventor: Louis J. Jasper, Jr., Fulton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/654,842

(22) Filed: Sep. 1, 2000

(51) Int. Cl.[7] ..... H01Q 15/08
(52) U.S. Cl. ..... 343/701; 343/754; 343/911 L
(58) Field of Search ..... 343/911 R, 911 L, 343/753, 754, 701; H01Q 15/08

(56) References Cited

U.S. PATENT DOCUMENTS 5,225,668 A * 7/1993 Hilliard et al. ..... 343/911 L
5,384,458 A * 1/1995 Hilliard et al. ..... 343/911 L
5,821,908 A * 10/1998 Screenivas ..... 343/911 R
6,262,688 B1 * 7/2001 Kasahara ..... 343/766

* cited by examiner

*Primary Examiner*—Michael C. Wimer
(74) *Attorney, Agent, or Firm*—Paul S. Clohan, Jr.; William V. Adams

(57) ABSTRACT

A device for generating and radiating pulses of radio frequency/microwave energy in response to pulses of laser light in which a metal layer is ohmically bonded to each side of a substrate of semiconductior material and an antenna bowtie pattern is ohmically bonded to the metal layers to form a feed structure for a Luneburg lens type antenna. There is at least one aperture available on the substrate of the semiconductor material for permitting laser light to reach the disk to produce photoconduction. The photoconductive switch is electrically connected to the storage device to facilitate fast discharge of the stored energy through the switch. The feed structure is mounted on a motorized support stand, which is connected to a center post by an arm that can rotate 360° in the azimuthal direction and ±90° in elevation. The feed structure is located on the outermost shell of the Luneburg lens, and is concave to conform to the focal radius of curvature of the outermost shell. The feed structure remains at a fixed radius from the center of the Luneburg lens as it rotates about the outermost shell. One embodiment uses a hemispherical Luneburg type lens to produce a highly directional beam by having the rays from the feed structure enter the Luneburg lens and reflect off of the ground plane. The other embodiment uses a spherical, or an almost spherical Luneburg type lens to produce a highly directional beam by having the radiation from the feed structure enter the Luneburg lens and speadout to emerge from the opposite diagonal point as a parallel beam. Both embodiments can rapidly scan 360° in the azimuthal direction and approximately ±90° in elevation.

12 Claims, 5 Drawing Sheets

MICROWAVE GENERATOR/RADIATOR USING PHOTOCONDUCTIVE SWITCHING AND DIELECTRIC LENS

RIGHTS OF THE GOVERNMENT

The invention described herein may be manufactured, used, and licensed by or for the United States Government for governmental purposes without the payment to me of any royalty thereon.

FIELD OF THE INVENTION

This invention relates to the generation and radiation of microwave energy.

BACKGROUND OF THE INVENTION

The generation of microwaves using IR photoconductive (PC) switching has been around since the 1970s. With the improvements in laser sources and semiconductor materials in the 1980s and 1990s, much research has been conducted into the generation of high-power microwaves (HPM) using the PC switch approach. The output power of the PC switch is a function of the bias voltage, the on-state resistance, and the load impedance. The upper frequency limit of the microwaves is a function of the risetime of the laser pulse. A 500-picosecond risetime laser, generates a microwave frequency spectrum that is ultra-wideband with about 2 GHz as the upper frequency limit. The bandwidth of the microwave spectrum is a function of the laser pulsewidth and the bandwidth of the antenna. It is usually limited by the bandwidth of the antenna. When gallium arsenide (GaAs) and silicon (Si) are the materials of the PC switch, the pulsewidth is usually less than 100 ηs with repetition rates no more than several hundred Hertz. The use of silicon carbide (SiC) or gallium nitride (GaN) will allow μs pulsewidths and kHz repetition rates.

The Luneburg lens is a dielectric sphere or hemisphere, where the index of refraction varies with distance from the center of the sphere such that a point source incident on one face of the sphere is diverged to a parallel ray on the opposite face. Luneburg lenses have existed and been used in special purpose applications for over 50 years. They have been used primarily for radar reflector and antennas. Luneburg lenses have several important characteristics that can be exploited to produce a versatile microwave antenna. The efficiency of the Luneburg lens is above 75%, and can be as high as 90% at low microwave frequencies. The Luneburg lens antenna has excellent wide-angle scanning performance, good gain, and wide bandwidth over its range of performance. Its bandwidth is usually limited by the feed structure. Wide-angle scanning is realized by moving the feed point about the lens either mechanically, electrically, or a combination of the both. Since the lens has spherical symmetry, it can be scanned over 4π steradians. Rays emerging from the feed point, do not illuminate uniformly across the aperture, but spread out from the center of the sphere in elliptical ray paths, and move out to give parallel rays emerging from the opposite surface of the sphere. The feed pattern is multiplied by a factor of sec(α) to obtain the aperture illumination pattern, where α is the feed angle.

Luneburg lens can be fabricated by stacking dielectric sheets with hole and slot distributions such that at any given location within the lens, the local relative permittivity equals the square of the index of refraction prescribed by the classical Luneburg lens formula.

$$\epsilon_{eff}=2-(h^2+r^2)^{1/2}/R,$$

where h is the lateral distance of the specific layer from the center of the sphere, r is the radial distance from the center of a specific layer, and R is the radius of the sphere. Another method for fabricating a Luneburg lens, which is often used for satellite antennas, is to fabricate concentric shells where the selection of dielectric constants and thickness of the concentric shells is a step-wise approximation to the classical Luneburg lens equation. The lenses are typically manufactured from either Polystyrene or from Polyethylene beads. The materials are lightweight in their expanded form, but when molded or compressed to obtain the desired density and hence dielectric properties they can become heavy. One can reduce the weight of the lens by introducing metal Fat particles, slivers, cubes, or ceramics. This inventor prefers the use of ferroelectric particles, since they can have excellent dielectric strengths, low-loss tangents, and high dielectric constants ($\epsilon_r$>500). These characteristics for the embedded and host materials are compatible for handling large peak and average powers. The maximum frequency-of-operation places a limit on the shell thickness of about one wavelength or less to produce adequate gain and minimum manufacturing costs. Tradeoffs are made in the shell thickness, number of shells, materials used, and etc. to obtain the best antenna performance at minimal cost. For example, too many shells are difficult to construct, add cost, and can introduce air gaps between the shells. Air gaps can reduce the overall efficiency of the lens and defocus the beam, especially at high microwave frequencies. Present day lens designers using new sophisticated spherical wave modeling techniques can design profiles other then the classical Luneburg profile that varies $\epsilon_{eff}$ from 2 at the center of the sphere to 1 at the outer surface. A design profile that varies $\epsilon_{eff}$ from about 5 at the center of the sphere to 1 at the outer surface appears to be practical for producing a more compact, lighter antenna. These designs can be simulated and tailored to meet the antenna specifications prior to building the antenna.

The invention described herein is aimed at fulfilling the urgent military need for compact, high-gain/high-power sources and radiators that are rugged for the battlefield environments and are compatible for mobile, tactical platforms with DEWs and radars.

SUMMARY OF THE INVENTION

Briefly, the foregoing and other objects are achieved by using a semiconductor switch or an array of switches such as silicon carbide (SiC), gallium nitride (GaN), silicon (Si), or gallium arsenide (GaAs). The switch(s) are illuminated by laser energy that is in the infrared (IR) or ultraviolet (UV) spectra. Unlike microwave energy that is generated by a microwave tube, coaxial cable or waveguide is not required to transport the microwave energy to the antenna. In this invention, the photoconductive switch(s) is integral with the antenna, and is the feed structure for the antenna. Fiber optic cable is utilized to transport the IR or UV energy to the PC switch(s). In FIGS. 3 and 5, a PC switch is part of a bowtie antenna feed structure. High-voltage cables are used to bias the semiconductor switch. The switch in the off state behaves like an insulator. In the on state, the laser energy causes an impulse current to flow in the switch. The signature of the microwave radiation follows the fingerprint of the laser pulse. A fast risetime (<ηs) laser pulse will generate radiation in the microwave spectrum.

The bowtie feed structure is located on the outermost shell (the invisible $\epsilon_r$=1 shell of the classical Luneburg lens or other predetermined dielectric lens profile). A hemispherical Luneburg lens (FIG. 3) or an almost spherical Luneburg lens (FIG. 5) is mounted flush on a ground plane. The bowtie feed structure is mounted on a motorized stand such that the feed structure can be made to rapidly rotate 360° in the azimuth direction and at least 90° in elevation. The rapid wide-angle scanning feature of the inventive item is made possible because the microwave generator is the feed structure of the antenna, and waveguide or radio frequency (RF) cable is not required to transport the microwave energy. The IR or UV energy is transported from the laser source to the PC switch(s) by fiber optic cable. The fiber optic cable does not need to have a physical connection to the laser source. A small air gap between the laser source and fiber optic cable is utilized, and this air gap (if kept short) will not adversely decrease the laser energy to the switch(s). The dc cables that are required to bias the PC switch(s) need not be connected to the PC switch(s) until the feed structure is properly aligned with the Luneburg lens for irradiating the target. Then a contact switch is engaged to complete the electrical circuit and the switch is biased with the predetermined voltage. The switch is in the off state until the IR or UV energy illuminates the switch. Upon switch illumination, the microwave energy is generated and radiated a short distance from the outermost invisible $\epsilon_r$=1 shell of the Luneburg lens through each successive shell of the lens. For the spherical or almost spherical Luneburg lens embodiment, the rays emerge as parallel rays at the diagonally opposite point on the lens. For the hemispherical embodiment, the rays are reflected off of the surface of the ground plane, and the rays will follow the paths in accordance with Snell's law. A virtual source is present on the other side of the ground plane, and therefore two beams are produced (one from the real source and one from the virtual source). The result is that the antenna's effective aperture is double for the hemispherical configuration versus the spherical or almost spherical configuration. The hemispherical embodiment has the advantages of higher (about double) gain and smaller profile compared to the spherical or almost spherical embodiment. However, pointing and tracking is more complex, since the rays are reflected off of the ground plane.

This microwave generator/radiator using photoconductive switching and dielectric lens has benefits over previous art. PC switch antennas of previous art shown in U.S. Pat. Nos. 5,596,438, 5,491,490, 5,351,063, 5,319,218, 5,513,056, 5,283,584, 5,280,168, 5,262,657, and 5,227,621 do not have the capability of pointing, tracking, and scanning over 360° in the azimuth direction and 180° in elevation. A phase array scheme would be required to obtain wide-angle scanning, but the complete 360° in the azimuth direction and 180° in elevation coverage would still most likely not be possible and if it were possible, it would be a complicated, high-cost technique. Luneburg lens of previous art utilize microwave sources that transport the microwave energy from a source to the antenna feed structure via coaxial cable or waveguide. This requires the microwave source to rotate with the feed structure. For HPM applications, this limits the scanning speed, and 4π steradians coverage of the antenna. This invention overcomes these limitations because the microwave generator is the feed structure of Luneburg lens antenna.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

BRIEF DESCRIPTION OF THE INVENTION

Figure 1:
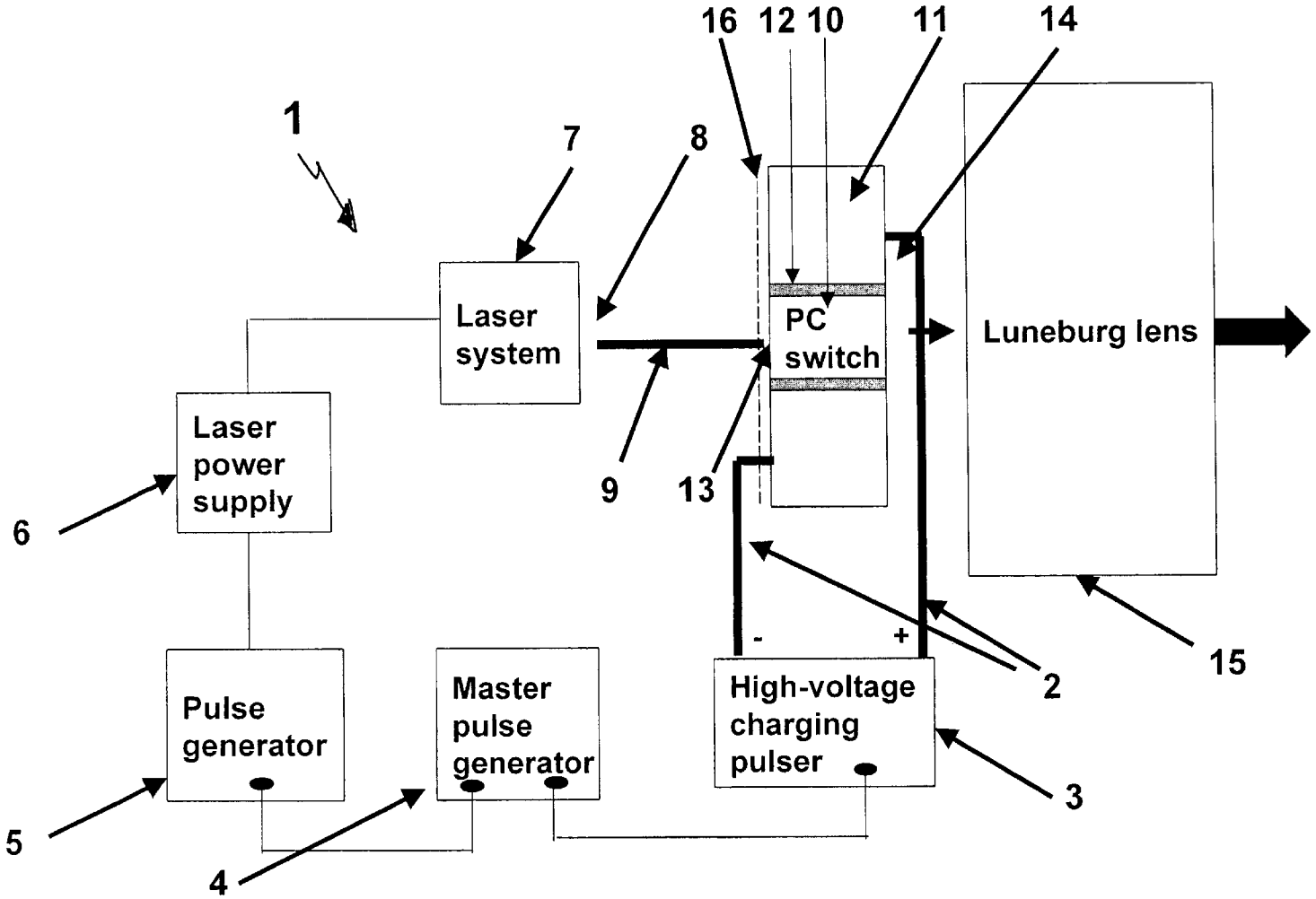
FIG. 1 is a block diagram showing the critical components of the microwave generator/radiator with a photoconductive (PC) switch and dielectric lens.

The Microwave Generator/Radiator Using Photoconductive Switching and Dielectric Lens consists of a prime power source (a battery pack), a power conditioning system (a capacitor bank, re-charging system, pulse forming network) to increase the voltage from the volt-level to the kilovolt-level, and an IR or UV laser system. These systems or similar systems are required to furnish the energy required to generate the microwaves. The laser system needs to have specific output parameters that are consistent with the PC switch utilized. A Si or GaAs switch has a band gap that is most efficiently illuminated by IR energy. A SiC switch has a band gap that is most efficiently illuminated by UV energy. The amount of laser energy supplied to the PC switch must be sufficient to illuminate the switch gap. The larger the switch gap, more laser energy is required and the on-state resistance is lowered. This is required for generating HPM. The type of PC switch chosen must be consistent with producing the desired peak and average microwave power. For HPM, a SiC or GaN PC switch is preferred, since they have a high dielectric strength and are capable of generating large repetition rates and large pulsewidths, and of holding off high-voltages. The antenna feed structure contains the PC switch, which is centered between two electrodes to form a bowtie structure. The laser energy that is transported from the laser source to the PC switch via fiber optic cable illuminates one or more surfaces of the PC switch. High-voltage dc cables are used to bias the PC switch. In the off state, the voltage is present across the switch, and the laser energy is off. In the on state, the laser energy and the voltage are both on. This causes current to flow through the switch with a profile that follows the laser pulse profile. The microwave impulse generated from the feed structure enters the classical Luneburg lens, and the rays follow elliptical paths and spread out in the center to emerge out of the lens as parallel rays. For the hemispherical embodiment, the rays are reflected off of the surface of the ground plane in accordance with Snell's law. For the spherical or almost spherical Luneburg lens, the rays enter the Luneburg lens such that they are not reflected off the ground plane. The advantages and disadvantages of the two embodiments are related to the gain, aperture size and pointing/tracking scheme. The Luneburg lens can be designed to obey the classical Luneburg lens equation, which changes the dielectric constant from a value of 2 at the center of the sphere to a value of 1 at the outermost shell. Other lens profiles can be utilized in this inventive item such as a profile that has a large dielectric constant at the center of the sphere. For example $\epsilon_r$=5 at the center and $\epsilon_r$=1 at the outermost shell.

The configuration of the feed structure is concave to the curvature of the Luneburg lens's outermost shell. It is placed with its effective phase center at the focal radius of the lens. It should approximate a point source. Its radius from the center of the sphere is always constant during rotation in the azimuth and elevation directions. A motorized stand that is attached to a central post (supports the ground plane and is located below the ground plane) rotates 360° in the azimuth direction. Rapid scanning is possible since the Luneburg lens is stationary and the feed structure rotates around the lens. Elevation rotation is accomplished by a motor mechanism that moves the feed structure in the vertical up and down directions. The stand that supports the feed structure is also concave to the curvature of the Luneburg len's outermost shell, or it must bend in a manner so that the feed structure remains at the constant focus radius of the lens. The feed structure radius is maintained at the radius of the outermost Luneburg lens shell during elevation rotation. The bowtie is also concaved to the same curvature as the outermost shell of the Luneburg lens to achieve a radiation pattern that approaches a point source. Techniques are available to those skilled in the art that allows the feed structure to be focussed in the near field and to have its effective phase center at the focus point of the lens. The dc and fiber optic cables are located inside the central post and antenna feed structure stand. This symmetry is ideal for rapid rotation and wideangle scanning. The fiber optic cable(s) is not physically attached to the laser source, and the dc cables are not attached to the capacitor bank until the system is ready for illuminating the target. A contact switch is used to electrically connect the capacitor bank to the PC switch. The contact switch is in the open position until the feed structure is aligned for target illumination. Then the contact switch is closed and laser energy is made to illuminate the PC switch. The laser output characteristics and power conditioning system specify the repetition rate and pulse width of the microwaves. Rapid charging of the bias voltage is required to maintain the repetition rate. Pulse forming lines, charging and discharging circuitry, and switch technologies are well known to those skilled in the art. The processes for pointing and tracking, wide-angle scanning, charging and discharging are repeated on each target and for different targets until the desired target effects are accomplished.

DETAILED DESCRIPTION OF THE PREFERRED EMBODIMENT

FIG. 1 is a system 1 incorporating a PC switch 10 for generating pulses of RF energy. One half of the bowtie antenna pattern 11 is connected to a voltage source 3 using high-voltage leads 2 of referenced potential (ground in this example) at any point. The other half of the bowtie antenna pattern 11 is connected to the high-voltage potential of the high-voltage charging pulser 3. High-voltage charging pulser 3 has the capability of producing multi-kilovolts in microseconds of charging times. The referenced potentials of the high-voltage charging pulser 3 are also connected to the metal electrodes 12 of PC switch 10 via high-voltage lead 2. A master pulse generator 4 supplies pulses at its charging pulse output to the input of the charging pulser 3. A triggered output of the master pulse generator 4 supplies pulses that are delayed with respect to the charging pulses to a trigger pulse input of a pulse generator 5. The pulse output of the pulse generator 5 is coupled to a laser supply 6. A laser system 7 is coupled to the laser power supply 6. A small air gap 8 separates the laser output section of the laser system 7 and a bundle of fiber optic cables 9. Fiber optic cables 9 conduct the pulses of laser light from the laser system 7 to the aperture(s) in the center of the metal electrodes 12. The pulses of RF energy are generated and radiated away from the feed structure 14 towards the Luneburg lens 15 which is located in the near field of the feed structure 14. Feed structure 14 has its effective phase center located on the focal radius of the lens. The rays emerge from the Luneburg lens 15 as parallel rays composing a highly directional beam with large gain. A reflecting metal plane 16 is located on the backside of feed structure 14 to concentrate the radiation pattern to approximate a point source that radiates in the forward direction towards the Luneburg lens 15.

Figure 2:
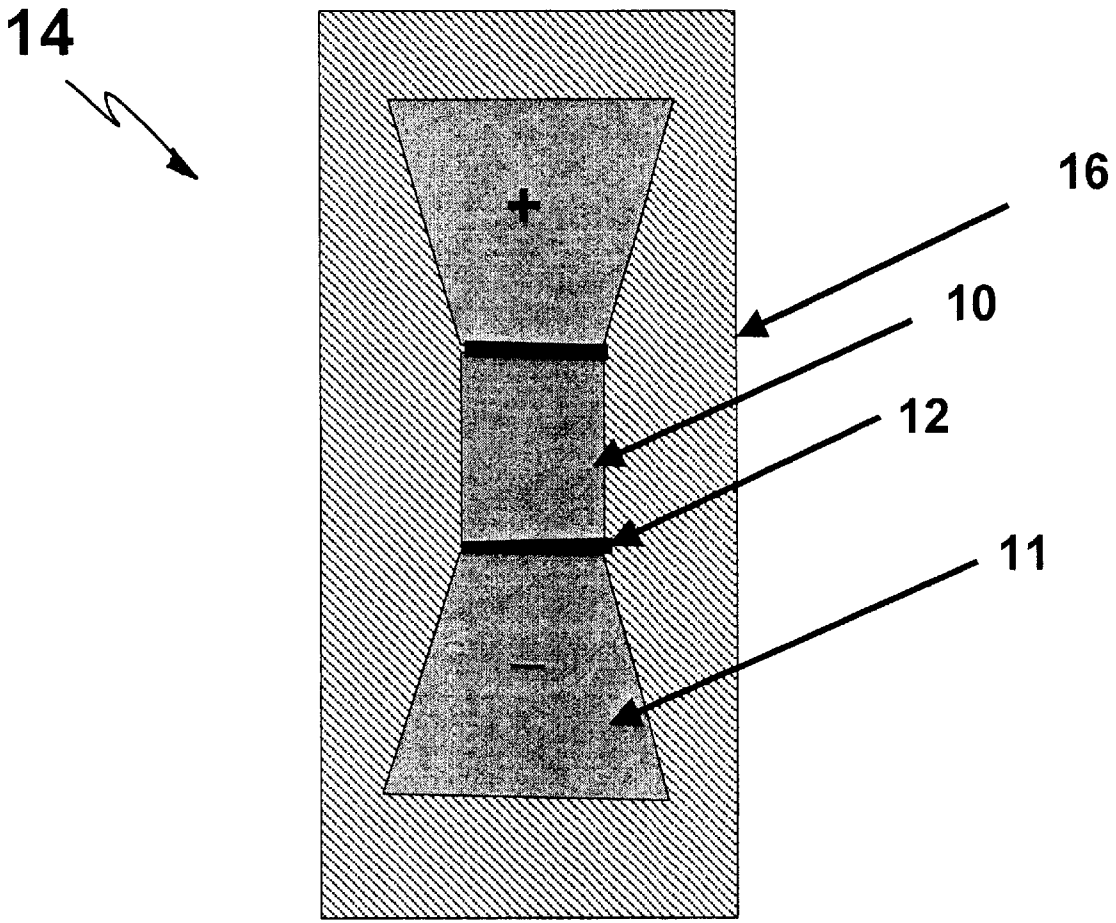
FIG. 2 is a frontal view of the antenna feed structure.

FIG. 2 is a frontal view of the antenna feed structure 14. The antenna feed structure 14 is concave so that it conforms to the outermost shell of the Luneburg lens 15. The PC switch 10 has two electrodes 12 with one electrode bonded to the high potential electrode side of the bowtie pattern 11 and the other electrode bonded to the ground potential side of the bowtie pattern 11. The reflecting metal plane 16 is located on the backside of the feed structure 14, and is physically connected to the support stand 17, and is electrically isolated from the bowtie pattern 11.

Figure 3:
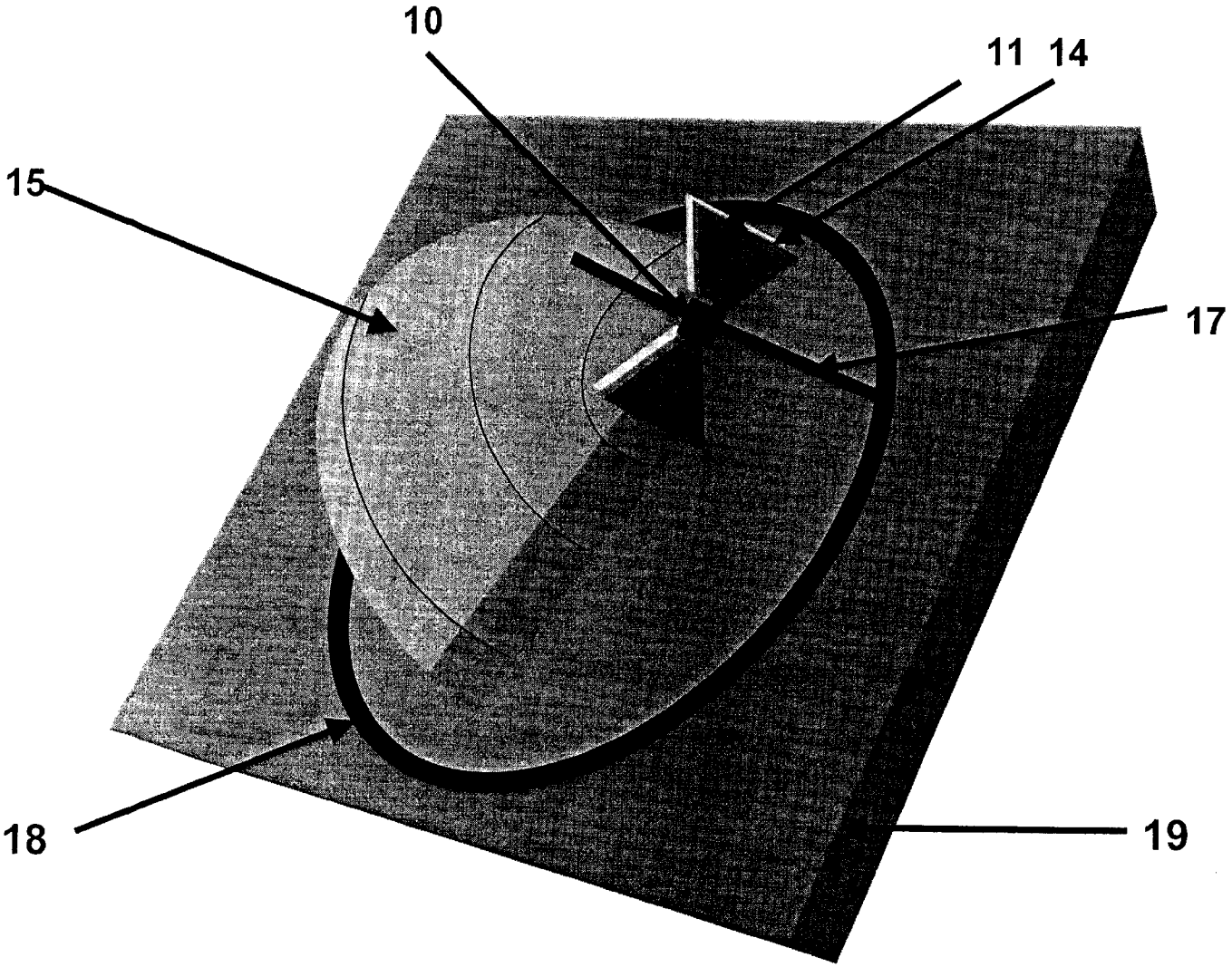
FIG. 3 is structural diagram of the microwave generator/radiator having a hemispherical Luneburg lens antenna mounted on a ground plane.

FIG. 3 is a structural diagram of the microwave generator/radiator having a hemispherical Luneburg lens antenna 15 mounted on a ground plane 19. Not shown in FIG. 3 is the reflecting metal plane 16 located behind the PC switch 10 and bowtie antenna pattern 11. The PC switch 10 and bowtie antenna pattern 11 and the reflecting metal plane 16 are all components of the antenna feed structure 14. Air gap 18 is a concentric ring that allows the motorized support stand 17 to rotate freely 360° in the azimuthal direction. Support stand 17 is concave to conform to the focal radius of curvature of the outermost shell of the Luneburg lens 15, or it is composed of parts that can bend and move so that the constant focal radius is maintained at all feed structure 14 positions. Not shown in the figure is the central post 20 which is located below the ground plane 19, and the arm 22 which attaches to the support stand 17 and central post 20.

Figure 4:
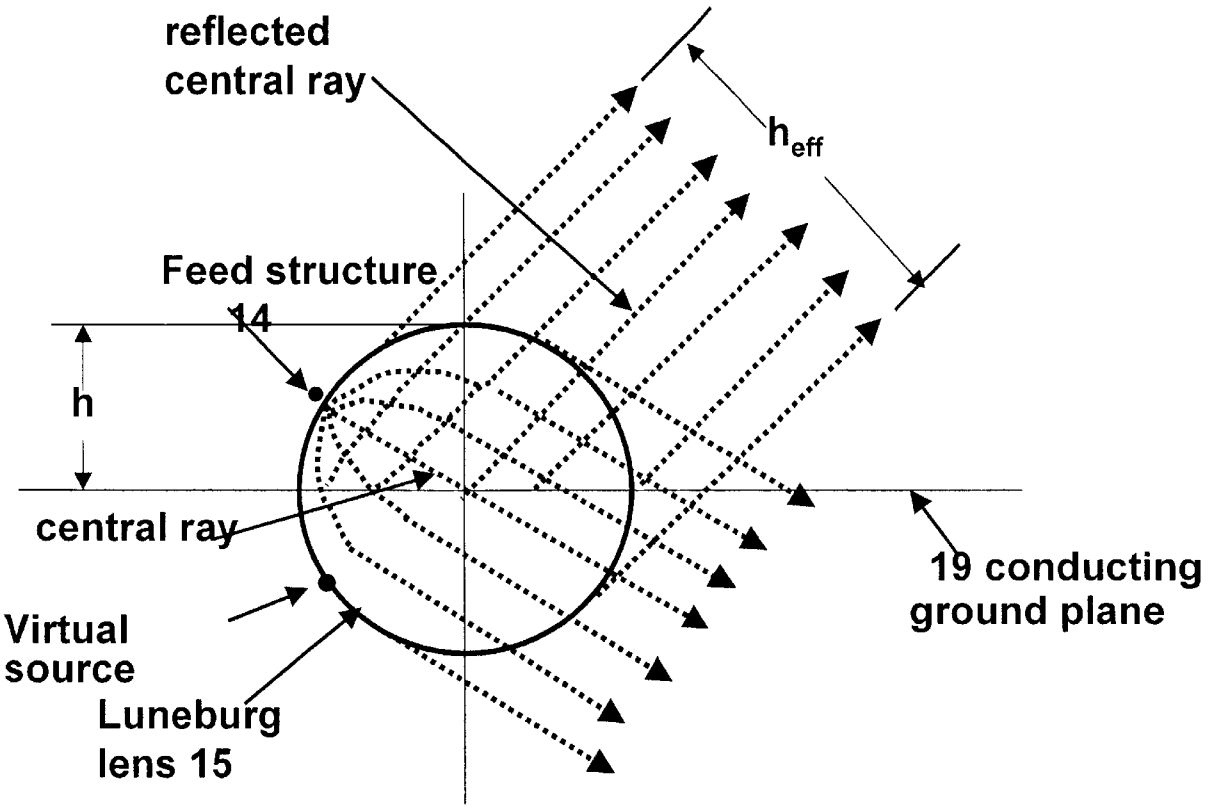
FIG. 4 shows the ray geometry for the hemispherical Luneburg lens.

FIG. 4 shows the ray geometry for the hemispherical Luneburg lens 15. The ray paths obey Snell's law and emerge from the Luneburg lens 15 as parallel rays that have an effective aperture length $h_{eff}$ that is double the actual aperture height h. The virtual source located below the ground plane produces a second beam, which contributes to the $h_{eff}$.

Figure 5:
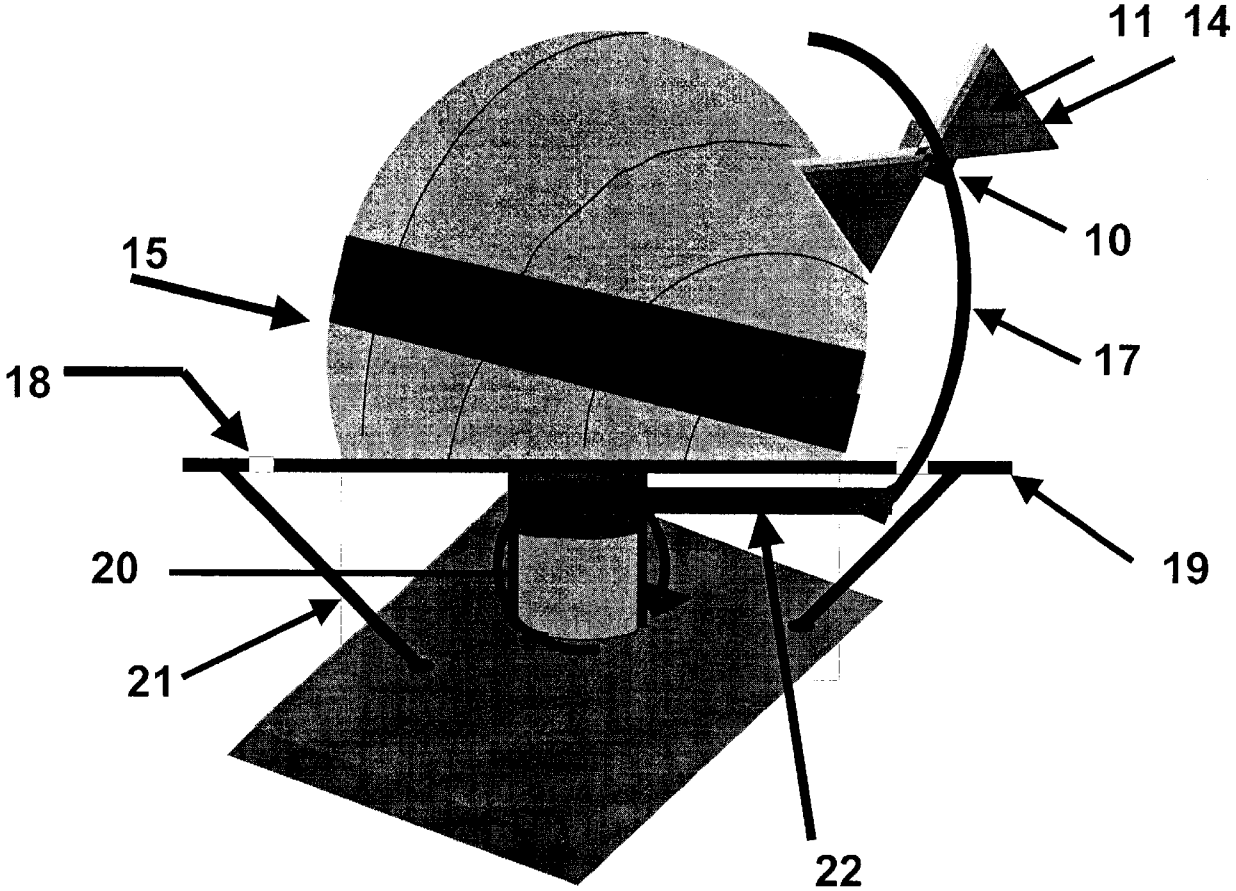
FIG. 5 is a structural diagram of the microwave generator/radiator having a spherical or an almost spherical Luneburg lens mounted on a ground plane.

FIG. 5 is a structural diagram of the microwave generator/radiator having a spherical or almost spherical Luneburg lens antenna 15 mounted on a ground plane 19. Not shown in FIG. 5 is the reflecting metal plane 16 located behind the PC switch 10 and bowtie antenna pattern 11. The PC switch 10 and bowtie antenna pattern 11 and the reflecting metal plane 16 are all components of the antenna feed structure 14. Air gap 18 is a concentric ring that allows the motorized support stand 17 to rotate freely 360° in the azimuthal direction. Support stand 17 is concave to conform to the focal radius of curvature of the outermost shell of the Luneburg lens 15, or it is composed of parts that can bend and move so that the constant focal radius is maintained at all feed structure 14 positions. Central post 20 along with ground supports 21 support the ground plane 19 and Luneburg lens 15. Arm 22 is attached to center post 20 and support stand 17. Arm 22 rotates either clockwise or counterclockwise around center post 20.

Although various embodiments of the invention have been described and shown herein, they are not meant to be limiting. Those skilled in the art may recognize certain modifications to these embodiments, which modifications are meant to be covered in the spirit and scope of the appended claims. For example, the bowtie antenna pattern is described herein as part of the feed structure. Other configurations such as a folded dipole over a reflecting sheet can also be used. The selected structure should have a radiation profile that approximates a point source. As another example, it is recognized that multiple feed structures in an array format, and with different high-voltage and fiber optic cables can be used to produce multiple beams for opto-electronic scanning, or for combining the EM fields in space.

I claim:

1. A device for use in generating and radiating pulses of radio frequency energy in response to pulses of laser light comprising:

a semiconductor substrate having at least two opposing surfaces each having a metalized electrode positioned to store electrostatic energy;

a power supply means for applying an electrical field in a predetermined direction across the electrodes such that said power is stored on said metalized electrodes;

an optical means for triggering the discharge of said stored energy, where said optical means is a laser source optically coupled to at least one surface of the semiconductor substrate;

an antenna feed structure for radiating RF energy onto an antenna lens;

an antenna lens for radiating RF energy onto selected targets; and a motorized support stand connected to a support arm and center post.

2. The device of claim 1 wherein the antenna feed structure comprises:

a semiconductor photoconductive switch;

a bowtie antenna with said photoconductive switch positioned between each half of the bowtie antenna;

a reflecting ground plane positioned on the backside of the bowtie antenna;

fiber optic cables positioned such that the open ends face at least one aperture of the photoconductive switch; and high-voltage dc cables with each cable attached to the metalized electrodes of the photoconductive switch.

3. The device of claim 2 wherein the antenna feed structure has a concave geometry so that its effective phase center conforms to the focal radius of curvature of the outermost shell of the antenna lens.

4. The device of claim 1 wherein the antenna lens is a Luneburg lens where the dielectric constant varies from a value of 2 at the center of the lens to a value of 1 at the outermost shell.

5. The device of claim 1 wherein the antenna lens has a selected dielectric profile where the dielectric constant varies from a selected value at the center of the lens to a value of 1 at the outermost shell.

6. The device of claim 4 wherein the antenna lens is composed of a lightweight host material drawn from the group of materials consisting of polyurethane or polystyrene, and doped with high-dielectric particles wherein said particles are selected from a group consisting of ferroelectrics or ceramics to reduce the size and weight of said dielectric lens.

7. The device of claim 6 wherein the antenna lens is a hemisphere mounted flush with a ground plane having an air gap annular configuration with a center radius equal to the focal radius of the outermost shell of the lens.

8. The device of claim 6 wherein the antenna lens is substantially spherical mounted flush with a ground plane having an air gap annular configuration with a center radius equal to the focal radius of the outermost shell of the dielectric lens.

9. The device of claim 1 wherein the support stand supports the antenna feed structure, is driven by motor means to allow rotation in both the azimuth and elevation directions, is fastened to a support arm and center post located below a reflecting ground plane and is located so as to pass through an air gap annular configuration in said ground plane.

10. The device of claim 9 wherein the antenna feed structure comprises: a semiconductor photoconductive switch;

a bowtie antenna with said photoconductive switch positioned between each half of said bowtie antenna;

fiber optic cables positioned such that the open ends face at least one aperture of the photoconductive switch;

high voltage dc cables with each cable attached to the metalized electrodes of the photoconductive switch; and said fiber optic and high-voltage dc cables are located inside the center post, support arm, and antenna feed support stand.

11. A device for use in generating and radiating pulses of radio frequency energy in response to pulses of laser light comprising:

a semiconductor substrate having at least two opposing surfaces each having a metalized electrode positioned to store electrostatic energy;

a power supply means for applying an electrical field in a predetermined direction across the electrodes such that said power is stored on said metalized electrodes;

an optical means for triggering the discharge of said stored energy, where said optical means is a laser source optically coupled to at least one surface of the semiconductor substrate;

an antenna feed structure for radiating RF energy onto an antenna lens;

an antenna lens for radiating RF energy onto selected targets, where said antenna lens is a Luneburg lens composed of a lightweight host material drawn from the group consisting of polyurethane and polystyrene and doped with high-dielectric particles, where said particles are selected from the group consisting of ferroelectrics and ceramics, where the dielectric constant varies from a value of 2 at the center of the lens to a value of 1 at the outermost shell, where said Luneburg lens is a hemisphere mounted flush with a ground plane having an air gap annular configuration with a center radius equal to the focal radius of the outermost shell of said lens; and a motorized support stand supporting said antenna feed structure driven by motor means to allow rotation in both the azimuth and elevation directions connected to a support arm and center post located below said ground plane located so as to pass through said air gap annular configuration in said ground plane wherein said support stand is concave to conform to the focal radius of curvature of the outermost shell of said lens.

12. A device for use in generating and radiating pulses of radio frequency energy in response to pulses of laser light comprising:

a semiconductor substrate having at least two opposing surfaces each having a metalized electrode positioned to store electrostatic energy;

a power supply means for applying an electrical field in a predetermined direction across the electrodes such that said power is stored on said metalized electrodes;

an optical means for triggering the discharge of said stored energy, where said optical means is a laser source optically coupled to at least one surface of the semiconductor substrate;

an antenna feed structure for radiating RF energy onto an antenna lens;

an antenna lens for radiating RF energy onto selected targets, where said antenna lens is a Luneburg lens composed of a lightweight host material drawn from the group consisting of polyurethane and polystyrene and doped with high-dielectric particles, where said particles are selected from the group consisting of ferroelectrics and ceramics, where the dielectric constant varies from a value of 2 at the center of the lens to a value of 1 at the outermost shell, where said Luneburg lens is a hemisphere mounted flush with a ground plane having an air gap annular configuration with a center radius equal to the focal radius of the outermost shell of said lens; and a motorized support stand supporting said antenna feed structure driven by motor means to allow rotation in both the azimuth and elevation directions connected to a support arm and center post located below said ground plane located so as to pass through said air gap annular configuration in said ground plane wherein said support stand can bend and move so as to conform to the focal radius of curvature of the outermost shell of said lens.

* * * * *